United States Patent [19]

Giangiulio

[11] 4,091,579

[45] May 30, 1978

[54] SCRAPER

[76] Inventor: Clayton Giangiulio, 5 Skyline Dr., Malvern, Pa. 19355

[21] Appl. No.: 689,396

[22] Filed: May 24, 1976

[51] Int. Cl.[2] ..... B24B 23/00

[52] U.S. Cl. ..... 51/181 R; 15/111

[58] Field of Search ..... 15/111, 176, 236 R, 15/143 R; 30/169, 171, 172, 295; 51/168, 181 R, 205 R; 7/1 R, 1 A; 294/131

[56] References Cited

U.S. PATENT DOCUMENTS

| | | | |
|---|---|---|---|
| 369,314 | 9/1887 | Brougher | 30/295 X |
| 840,832 | 1/1907 | Everett | 30/295 |
| 972,225 | 10/1910 | Pennell | 30/169 |
| 1,536,542 | 5/1925 | Wegner | 15/111 |
| 1,538,300 | 5/1925 | Raney | 30/295 |
| 1,696,561 | 12/1928 | Alexander | 30/171 |
| 2,295,693 | 9/1942 | Seigh | 51/205 R |
| 2,747,911 | 5/1956 | Kuever | 30/169 X |
| 2,799,037 | 7/1957 | Grogan | 15/176 X |
| 2,855,618 | 10/1958 | Jones | 15/176 X |

*Primary Examiner*—Gary L. Smith
*Attorney, Agent, or Firm*—Caesar, Rivise, Bernstein & Cohen

[57] ABSTRACT

A grill and griddle scraper comprising an elongated shaft having a working end, an intermediate portion, a hand grasping end and a barrier wall interposed between the working end and the intermediate portion. The grasping end includes a handle having a portion for encircling ones hand when said handle is grasped. The intermediate portion provides the means for grasping the scraper with the other hand to enable the device to be used to scrape grills and griddles. The barrier wall is provided to preclude the hand on the shaft from sliding down the shaft and into contact with the grill or griddle being scraped. The working end includes a tool holder having first means releasably securing scouring means thereto and second means releasably securing a scraping blade thereto. The scouring means may comprise either an abrasive stone or a brush and is frictionally held within a recess in the first releasable securing means. The first releasable securing means is held onto the tool holder via a projection extending from the tool holder and into a groove in the first releasable securing means. The second releasable securing means includes a planar ledge disposed opposite the projection and which receives the scraping blade thereon. Threaded fastening means are provided to secure the blade in place on the ledge and to hold the projection of the tool holder into the groove in the releasable securing means while ensuring that the scouring means is held tightly within its associated recess.

1 Claim, 11 Drawing Figures

FIG. 3
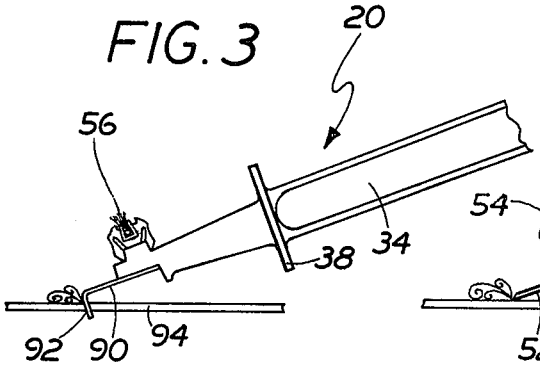
FIG. 5
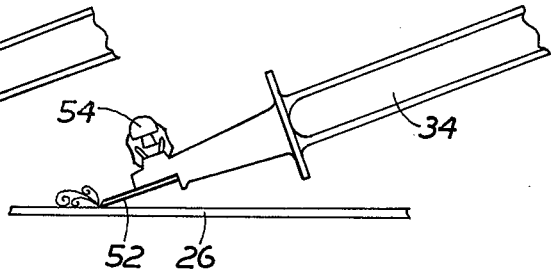
FIG. 4
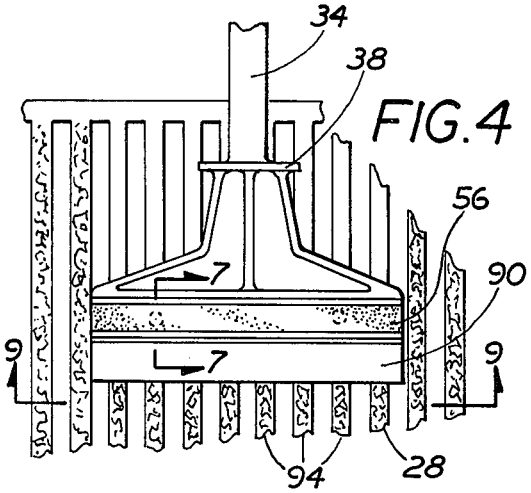
FIG. 6
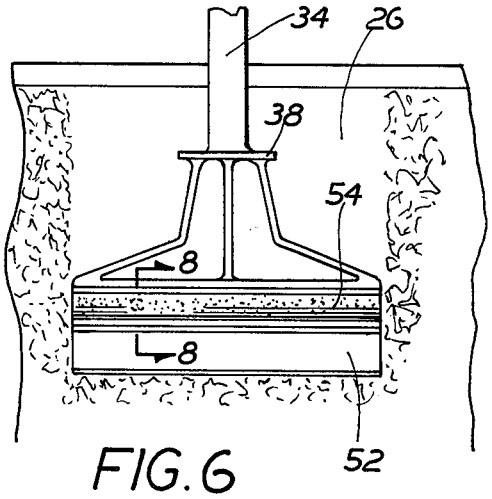
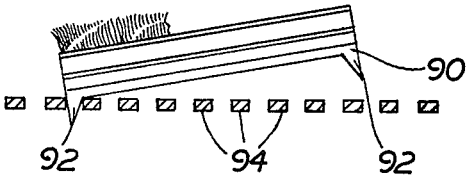
FIG. 9
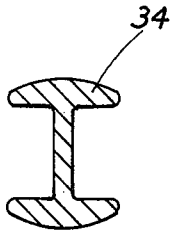
FIG. 11
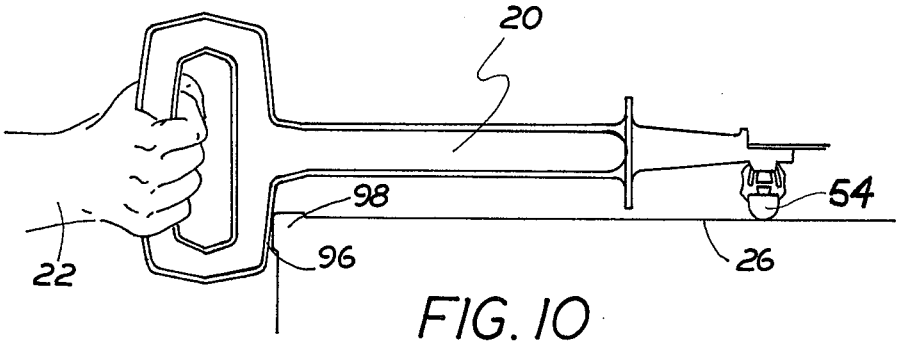
FIG. 10

SCRAPER

This invention relates generally to cleaning devices and more particularly to devices for scraping either grills or griddles.

Various grill or griddle scrapers have been disclosed in the prior art and many types are commercially available. However, each of the prior art scrapers suffers from one or many drawbacks. For example, some scrapers are particularly adapted for scraping grills due to their use of grooved blades but are incapable of scraping griddles at all or even effectively enough to be suitable for commercial applications due to their lack of straight edged blades. Examples of such prior art grill scrapers are found in the disclosures of the following U.S. Pat. Nos.: 2,747,911 (Kuever); 2,807,814 (Leeming); 2,824,323 (Tos et al); 3,666,987 (Giustino); 3,434,175 (Bray); 3,487,491 (Dunn); 3,800,354 (Stephens); and 3,820,185 (Phillips).

While straight edged blade scrapers operative for scraping griddles have been disclosed and are commercially available, such devices are not viable on a commercial basis for quickly and effectively scraping the many wire rods forming a commercial grill.

Accordingly, it is a general object of this invention to provide a combination grill and griddle scraper which overcomes the disadvantages of the prior art and which can be used on a commercially viable basis.

Another drawback of the prior grill and/or griddle scrapers is their dangerous potensity to enable the user's hands to contact the hot grill or griddle during the scraping operation.

Accordingly, it is a further object of this invention to provide a combination grill and griddle scraper which includes means for protecting the user's hands from contact by the hot grill or griddle during the scraping operation.

Another drawback of the prior art scrapers is their inability to permit the rapid changing of different blades, brushes and abrasive stones for effecting various cleaning operations.

Accordingly, it is a further object of this invention to provide a grill and griddle scraper including means for readily permitting different blades, brushes and abrasive stones to be used in order to accomplish various cleaning operations on grills and griddles.

The foregoing, as well as other objects of the invention are achieved by providing a device for cleaning grills and griddles. The device comprises an elongated shaft having a working end, an intermediate portion, a grasping end and a barrier wall interposed between the working end and the intermediate portion. The grasping end terminates in a handle including a portion encircling one's hand when said hand grasps the handle. The intermediate portion serves as the means for grasping the device with the other hand to enable the device to be used to scrape grills and griddles. The barrier wall serves to preclude the other hand from sliding down the shaft and into contact with the grill or griddle being scraped. The working end terminates in a tool holder which includes first means releasably securing scouring means thereto and second means releasably securing a scraping blade thereto. The scraping blade extends away from the scouring means.

In accordance with one aspect of this invention the blade comprises a straight edged blade for effectively scraping grills. In accordance with another aspect of this invention the blade includes at least one triangular shaped projection extending at an angle to the remaining portion of the blade for effectively scraping the wires of a grill. In accordance with yet another aspect of the invention the scouring means comprises an abrasive stone. In accordance with still a further aspect of the invention the scouring means comprises a brush.

Other objects and many of the attendant advantages of the instant invention will become readily apparent by reference to the accompanying drawings wherein:

FIG. 3 is a side elevational view of the device shown in FIG. 1 but including a grill scraping blade for effecting the scraping the wires of a grill;

FIG. 4 is a top elevational view of the portion of the device shown in FIG. 3;

FIG. 5 is a side elevational view of the device shown in FIG. 1 in operation scraping a griddle;

FIG. 6 is a top elevational view of the portion of the device shown in FIG. 5 in operation;

FIG. 9 is a sectional view taken along line 9—9 of FIG. 4;

FIG. 10 is a side elevational view of the device shown in FIG. 1 disposed in its resting or inoperative position; and FIG. 11 is an enlarged sectional view taken along line 11—11 of FIG. 2.

Referring now in greater detail to the various figures of the drawing wherein like reference characters refer to like parts, there is shown generally at 20 in FIG. 1 an improved combination scraping device in accordance with the instant invention.

Figure 1:
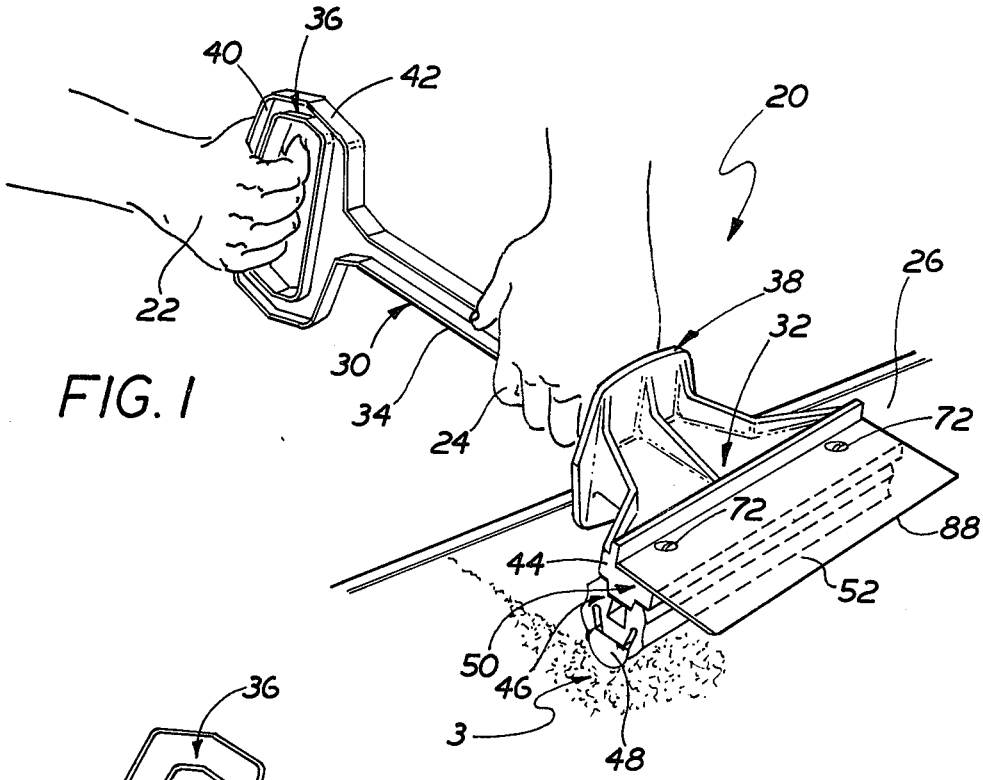
FIG. 1 is a perspective view of a scraper in accordance with my invention in operation scouring a grill.
Figure 2:
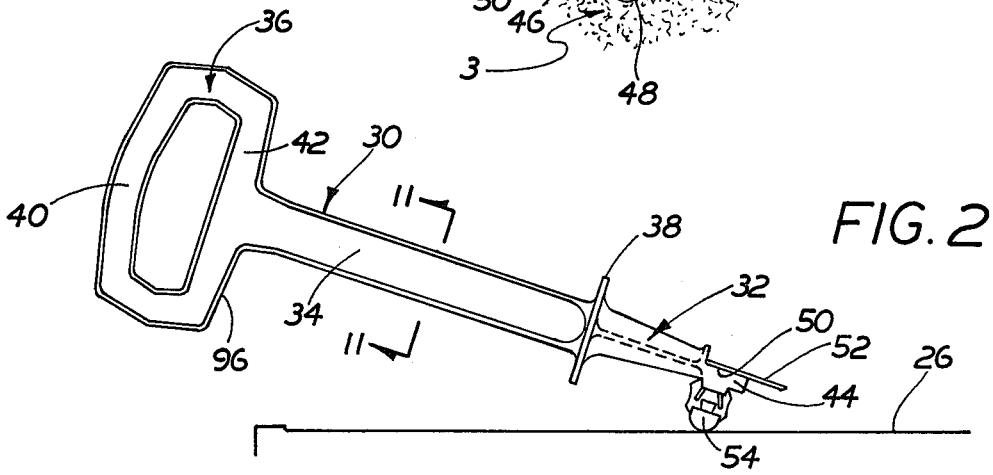
FIG. 2 is a side elevational view of the device shown in FIG. 1 when scouring said grill.

As can be seen the device 20 is adapted for grasping by a user's hands 22 and 24 to effect the scraping of a griddle 26. However, as will be described in detail later, by the mere replacement of a blade the device 20 is particularly suited for the scraping of a grill 28 (see FIG. 4).

The scraping device 20 basically comprises an elongated shaft 30 having a working end 32, an intermediate portion 34, a hand grasping end 36 and a barrier wall 38 interposed between the working end 32 and the intermediate portion 34. The grasping end includes a handle 40 having a portion 42 for encircling the user's hand 22 when the handle 40 is grasped. The intermediate portion 34 provides the means for grasping the scraping device 20 with the other hand 24 of the user.

In accordance with a preferred embodiment of the invention the portions 30, 32, 34, 36 and 38 are formed as an integral unit, e.g., as an aluminum extrusion.

The working end 32 of the device 20 terminates in a tool holder 44 having first means 46 for releasably securing scouring means 48 thereto and second means 50 for releasably securing a scraping blade 52 thereto. The scouring means may comprise either an abrasive stone 54 (FIG. 8) or a brush 56 (FIG. 7) held within a channel-shaped backing 59, depending upon whether the device is to be used on a griddle or a grill, respectively.

Figure 8:
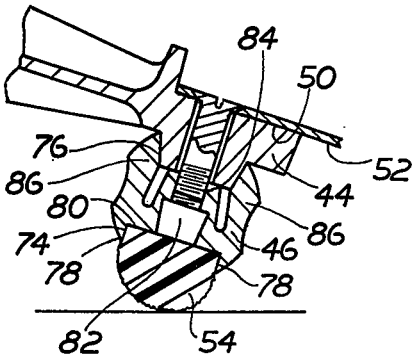
FIG. 8 is an enlarged sectional view taken along line 8—8 of FIG. 6.
Figure 7:
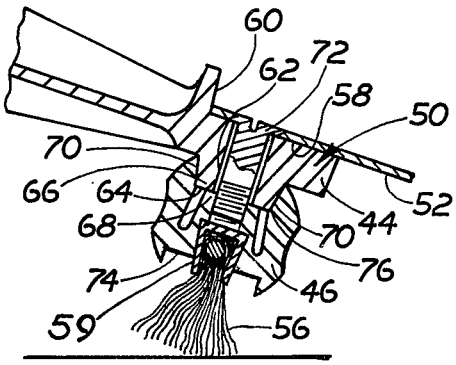
FIG. 7 is an enlarged sectional view taken along line 7—7 of FIG. 4.

The details of the tool holder 44 can best be seen in FIGS. 1, 7 and 8. As can be seen therein, the tool holder 44 is an elongated member lying at the free end of working end 32. The longitudinal axis of the tool holder 44 extends transversely to the longitudinal axis of the shaft 34 and is generally co-planar therewith. The upper surface of the tool holder 44 includes an elongated planar ledge 58 and a flange or stop 60 projecting upward normally therefrom. A pair of openings 62 extend through the body of the tool holder 44 from the ledge 58 to the underside 64 of the tool holder. The underside of the tool holder includes a portion 66 extending the full width of the tool holder 44. As can be seen, the projection 66 includes a planar bottom surface 68 and a pair of sloping side walls 70.

The ledge 58, in conjunction with the stop 60, serves to mount either a griddle scraping blade 52 or a grill scraping blade, to be described later, on the tool holder. Either type of blade is secured in place via the use of a pair of threaded fasteners or screws 72 extending through the openings 62. The fasteners 72 also serve to secure the first releasable securement means 46 onto the tool holder.

As can be seen in FIGS. 1, 7 and 8, the releasable securement means 46 is an elongated member of a co-extensive length with the length of the tool holder 44.

The member includes a recess 74 extending along the full length of the member 46 and disposed opposite to the recess 74 is a groove 76 extending the full length of the member 46. The recess 74 includes an opposed pair of parallel side walls 78 and a bottom wall 80 including a communicating flared channel 82 co-extensive in length with the bottom wall 80 and adapted to receive a mating portion of the channel-shaped brush backing 59. A pair of threaded openings 84 extend from the flanged channel 82 to the tapered groove 76 and are axially aligned with the opening 62 in the tool holder 44. The screws 72 are thus enabled to extend through the aligned openings 62 and 84 to secure the first securement means 46 onto the tool holder.

When the securement means 46 is mounted on the tool holder, the elongated projection 66 is received within the groove 76. The groove 76 includes a pair of channels 86 extending the full length of member 46 and communicating with the side walls of the groove 76 to form a pair of resilient fingers 86. As will be appreciated, upon the tightening of screws 72, the projection 66 is pulled into the groove 76, whereupon the fingers 86 of the securement means 46 flex slightly outward, thereby causing the side walls 78 of recess 74 to move towards each other. This action effects the frictional engagement of the scouring means 48 within the recess 74. By unloosening the screws 72 either the abrasive stone 54 or the brush 56 type scouring means 48 can be mounted on the device 20, thereby providing great flexibility for the scraper.

In addition to aiding in the mounting of the scouring means on to the tool, the screws 72 also serve to secure either type of scraping blade onto the tool holder.

The device 20 shown in FIG. 1 includes a scraping blade having an elongated linear cutting edge 88. The cutting edge 88 is particularly suited for scraping of a flat surface such as a griddle. In this regard, it is preferable that the cutting edge 88 lie in the same plane as the blade 52.

With the device 20 arranged as shown in FIG. 1 the effective cleaning of griddles can be accomplished by first utilizing the cutting edge 88 of the blade 52 in the manner like that shown in FIGS. 5 and 6. This action causes the grease and other cooking residue to be scraped from the griddle.

It should be noted at this juncture that the device 20 exhibits several personnel safety features. For example, the barrier wall 38 prevents the user's hand 24 from sliding down the shaft 34 and into contact with the hot grill or griddle being scraped. In addition, the barrier wall 38 provides a grease shield to prevent any hot grease or other material being scraped from splashing back and onto the hand of the user.

By virtue of the construction of the encircling handle 42, a gauntlet-type arrangement is provided, to protect the other hand of the user.

Once the grease is scraped from the griddle 26 the device 20 is inverted from the position shown in FIGS. 5 and 6 to the position shown in FIG. 1, whereupon the scouring stone 54 is brought into contact with the previously scraped griddle to polish it.

In order to convert the device 20 from its griddle cleaning configuration to its grill cleaning configuration so as to permit the quick and effective scraping of the bars of a grill, the blade 52 is replaced by a fanged blade 90 (see FIGS. 4 and 9). As can be seen, the blade 90 is a generally planar member, like blade 52, but includes a pair of angularly extending triangular portions or fangs 92 projecting from each corner of the blade. In accordance with the preferred embodiment of the invention, the diagonally extending sides of the fanged portions 92 extend toward the middle of the scraper. This feature ensures that the blade 90 is effective for scraping all types of grills, irrespective of the spacing between the bars 94 which make up the grill. As can be seen in FIG. 3, the fanged projections 92 extend generally normally to the plane of the blade 90. Like blade 52, blade 90 includes a pair of openings for receipt of the fastening screws 72.

In accordance with a preferred embodiment of this invention, when the device 20 is used as a grill scraper the scouring means 48 used is a brush 56 to permit scraped grease and food remains to be brushed from the bars 94 of the grill.

In FIG. 3 there is shown the operation of the device 20 when scraping the bars 94 of a grill.

In the interests of strength and rigidity, the elongated shaft 30 is formed of a general I-beam construction as can be seen in FIG. 11.

In FIG. 10 the device is shown in its storage position resting on the surface of a griddle 26. To that end, as can be seen, the device is disposed on the griddle 26 with the abrasive stone 54 resting on the griddle surface and with the slightly tapered forward edge 96 of the grasping portion 42 resting on the forward corner 98 of the griddle. When disposed thusly the device is readily accessible and handy for use.

As should be appreciated from the foregoing, the scraping device 20 of the instant invention permits universal and flexible use on both griddle surfaces and grill bars. The device accommodates four scraping attachments, namely, a griddle scraping blade 52, a griddle polisher or abrasive stone 54, a fanged grill scraping blade 90 and a grill brush 56. Furthermore, in accordance with a preferred aspect of this invention, two of the attachments can be accommodated simultaneously, that is, the griddle scraping blade and polishing stone or the grill scraping blade and brush, thereby obviating the need for two separate utensils for a griddle and two separate utensils for a grill.

By virtue of the novel mounting arrangement for the attachments any one of the four types of attachments can be readily replaced.

The rugged construction of the integral extrusion makes the device particularly adapted for commercial use and eliminates chattering and squeaking, which heretofore have been common deficiencies of prior art scrapers.

The handle of device 20 with its gauntlet-type hand guarding configuration is particularly suited for protecting the user's hand from contacting a potentially hot griddle or grill surface during use of the device. In addition, the barrier wall 38 precludes the other hand of the user from contacting the grill or griddle while also serving as a grease deflector to further protect the user's hands from any grease which may spatter in the direction of the hand as the device is advanced across the grill or griddle surface during operation.

Without further elaboration, the foregoing will so fully illustrate my invention that others may, by applying current or future knowledge, readily adapt the same for use under various conditions of service.

I claim:

1. A device for cleaning grills and griddles comprising an elongated shaft having a working end, an intermediate portion, a grasping end and a barrier wall interposed between said working end and said intermediate portion and spaced from said working end, said grasping end terminating in a handle disposed generally normally to the axis of said shaft and including a portion encircling one's hand when said hand grasps said handle, said intermediate portion serving as the means for grasping said device with the other hand to enable the device to be used to scrape grills and griddles, said barrier wall projecting circumferentially outward from said shaft and being of sufficient size to preclude said other hand from sliding down said shaft and into contact with the grill or griddle being scraped, said working end terminating in a tool holder, said tool holder including first means releasably securing either a first or a second scouring means thereto and second means releasably securing either a first or a second scraping means thereto, said first scouring means comprising an elongated abrasive stone and said second means comprising a brush having a flared channel-shaped backing member, said first releasable securing means comprising an elongated member having a recess for receipt of said abrasive stone and including a pair of side walls and an elongated tapered groove disposed opposite to said recess, said tool holder including a projection extending therealong and secured within said groove, said projection being tapered such that when disposed within said groove the side walls of the recess flex to frictionally engage the abrasive stone and hold it in place, said recess including a tapered central channel adapted for receipt of the brush backing member therein, said first scraping means comprising a planar blade and said second scraping means comprising a blade having a planar portion and at least one fanged projection extending at an angle to the planar portion, said second releasable securing means comprising a planar ledge on said tool holder for mounting either of said blades thereon via threaded fastening means.

* * * * *